United States Patent [19]

Beck et al.

[11] 4,425,266

[45] Jan. 10, 1984

[54] USE OF N-OXALKYLATED DERIVATIVES OF ANILINE AS A POLYMER-DISSOLVING COMPONENT IN FLOOR CLEANERS

[75] Inventors: Rudolf Beck; Sigrid Scholz-Weigl, both of Marl, Fed. Rep. of Germany

[73] Assignee: Chemische Werke Huels Aktiengesellschaft, Marl, Fed. Rep. of Germany

[21] Appl. No.: 350,931

[22] Filed: Feb. 22, 1982

[30] Foreign Application Priority Data

Feb. 21, 1981 [DE] Fed. Rep. of Germany ..... 3106491

[51] Int. Cl.[3] ..... C11D 7/32; C11D 7/50

[52] U.S. Cl. ..... 252/548; 134/38; 252/156; 252/158; 252/171; 252/525; 252/529; 252/544; 252/DIG. 8

[58] Field of Search ..... 252/156, 158, 153, 525, 252/529, 544, 548, 171, DIG. 8; 134/38

[56] References Cited

U.S. PATENT DOCUMENTS

| | | | |
|---|---|---|---|
| 3,239,468 | 3/1966 | Herrick | 252/153 X |
| 3,723,148 | 3/1973 | Tupper | 106/287 PR |
| 3,766,076 | 10/1973 | Murphy | 252/156 |
| 3,954,648 | 5/1976 | Belcak et al. | 252/158 |
| 3,962,151 | 6/1976 | Dekker et al. | 252/548 |
| 4,077,896 | 3/1978 | Bunegar et al. | 252/90 |

*Primary Examiner*—P. E. Willis, Jr.
*Attorney, Agent, or Firm*—Millen & White

[57] ABSTRACT

N-oxalkylated derivatives of aniline of the formula

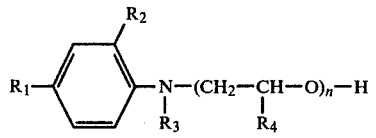

wherein $R_1$ and $R_2$ each independently is hydrogen, $NH_2$, or lower alkyl;

$R_3$ is hydrogen or lower alkyl, $R_4$ is hydrogen or methyl, and n is a number from 1.0 to 5.0, are useful as polymer-dissolving components in floor cleaners.

13 Claims, No Drawings

USE OF N-OXALKYLATED DERIVATIVES OF ANILINE AS A POLYMER-DISSOLVING COMPONENT IN FLOOR CLEANERS

BACKGROUND OF THE INVENTION

N-Phenyldiethanolamine

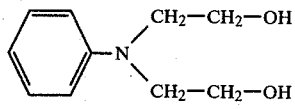

(produced by chemical addition of 2 moles of ethylene oxide to aniline *without* catalyst addition) is primarily utilized for dissolving the polymers in floor cleaners (e.g., in cleaners of the self-polishing, floor finish stripping type). (See, e.g., W. E. Draper, L. P. Johnson, Soap & Chemical Specialties, January 1971, pages 38–44, 74, and 75, whose disclosure is incorporated by reference herein). This product has the disadvantage that a blue discoloration appears in the product proper and also in the surfaces to be cleaned, such as stone, wood, synthetic resins, and varnished surfaces, after a certain period of time. This blue coloring is troublesome because the original color assumes a blue tinge as a consequence. As a function of the cleaning procedures employed, this blue coloring is not uniform but rather results in a more or less strong dyeing effect. Splattered droplets, unless removed, create deep-blue spots of color. These blue discolorations can be removed only with great difficulty, or even not at all.

SUMMARY OF THE INVENTION

It is an object of this invention to provide a new agent in such products for dissolving polymers which eliminates or ameliorates these disadvantages.

Upon further study of the specification and appended claims, further objects and advantages of this invention will become apparent to those skilled in the art.

These objects have been attained and it has now been found that these troublesome blue colorations do not occur with the use of N-oxalkylated derivatives of aniline of the formula

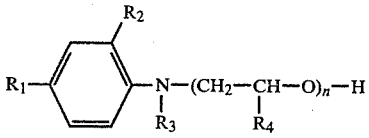

wherein $R_1$ and $R_2$ each independently is hydrogen, $NH_2$ or lower alkyl of 1–4 carbon atoms, (they need not be identical), $R_3$ is hydrogen or lower alkyl of 1–4 carbon atoms, $R_4$ is hydrogen or methyl, and n has a value of 1.0–5.0, as the polymer-dissolving component in floor cleaners.

DETAILED DESCRIPTION

Compounds of the formula

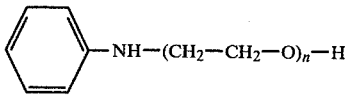

wherein n has a value from 1 to 5, especially 1 to 3, are preferred.

Thus, according to this invention, the following N-oxalkylated derivatives of aniline can be used as the polymer-dissolving component in floor cleaners, for example: reaction products of o-toluidine, p-toluidine, p-phenylenediamine, N-methyl-aniline with the corresponding number of moles of ethylene oxide and/or propylene oxide, preferably reaction products of aniline with the corresponding number of moles of ethylene oxide and/or propylene oxide.

The respective N-oxalkylated aniline derivatives can be prepared by chemical addition of the corresponding number of moles of ethylene oxide and/or propylene oxide to aniline, as well as substituted aromatic amines, in the presence of alkaline catalysts. Suitable alkaline catalysts include: Na methylate, Na ethylate, Na n-propylate, sodium hydroxide, potassium hydroxide, potassium methylate and sodium phenolate. The reaction temperature usually is 120°–180° C., the reaction time 0.5–4 hrs. and the reaction pressure 2–10 bar. See, e.g. I. D. Malkemus, Journal of American Oil Chemists' Soc. 33, 574 (1956) who discribes the oxethylation of amines in general with or without catalyst, whose disclosure is incorporated by reference herein.

Preparation of N-(β-Hydroxyethyl polyethoxy) aniline

Under a nitrogen atmosphere, 440 g (10 moles) of ethylene oxide was chemically added to 465 g (5 moles) of aniline in an autoclave at about 140° C. and under 3 bar in the presence of 2.3 g of Na methylate. After the reaction was concluded, the mixture was purged with nitrogen for one-half hour, and the resultant reaction product was used without any further processing.

The following aniline derivatives can similarly be employed as the starting materials for the addition of ethylene oxide and/or propylene oxide: o-toluidine, p-toluidine, p-phenylenediamine, N-methylaniline, etc.

The most important effect of the products according to this invention is that they do not exhibit the troublesome blue coloration of the prior art agents. Furthermore, they show, in part, a markedly improved dissolving action on the polymers utilized in self-polishing floor waxes.

Several of the products of this invention were incorporated in the recipe for a floor cleaner as set forth below. It was employed for cleaning tests:

2.5% n-dodecylbenzenesulfonate Na salt
3.0% fatty acid triethanolamine salt
2.0% fatty acid amide polyglycol ether
2.0% butyl diglycol
3.0% triethanolamine
3.0% ethylenediaminetetraacetate
5.0% N-ethoxylated aniline
remainder to 100%: tap water For cleaning purposes, PVC tiles pretreated with commercial floor care agents ("GLÄNZER ®", "EMSAL ®") were utilized. The floor care agents were dyed with a dark hue (R 28032 ex. conc. BASF) to enhance the evaluation of the cleaning tests.

The scrubbing device (scouring device) of Gardner was used for the cleaning step. The cleaning action was determined using the filter colorimeter RFC 3 of Zeiss. The results are shown in Table 1.

TABLE 1

| | Cleaning Effect in Percent of Brightening | | | | |
|---|---|---|---|---|---|
| | According to Invention | | | | For Comparison |
| Aniline + | 1EO | 1.5EO | 2EO | 2.5EO | N—Phenyldiethanolamine |
| Commercial Product A "(Glänzer") | 86 | 70 | 65 | 32 | 52 |
| Commercial Product B ("emsal") | 81 | 72 | 65 | 29 | 65 |

Table 1 illustrates the cleaning effect of various N-oxalkylated aniline derivatives of this invention as compared with N-phenyldiethanolamine.

It was found that the products according to this invention, with 1–2 moles of EO, show markedly better cleaning results than the state of the art. Higher-ethoxylated products are not as superior. However, it is important for all agents of this invention to note that, under usage conditions approximating those of practical situations, no undesired blue coloration could be found even after several weeks.

| Examples of Formulations for Floor Cleaning Agents | |
|---|---|
| n-$C_{10-13}$—Alkylbenzenesulfonate Na salt | 3% |
| Fatty alcohol-1.5 mole EO-sulfate | 1% |
| Fatty acid triethanolamine salt | 2% |
| Nonylphenol + 12 EO | 2% |
| Na Metasilicate.$5H_2O$ | 2% |
| Nitrilotriacetate | 3% |
| N—(β-Hydroxyethylpolyethoxy)aniline (n = 2.0) | 6% |
| Remainder up to 100%: $H_2O$ | |
| Nonylphenol + 9 EO | 6% |
| Butyl glycol | 10% |
| Isopropyl alcohol | 3% |
| Potassium hydroxide solution, 50% strength | 1% |
| N—(β-Hydroxyethylpolyethoxy)aniline (n = 1.5) | 6% |
| Remainder up to 100%: $H_2O$ | |
| n-Dodecylbenzenesulfonate Na salt | 3% |
| Fatty acid Na salt | 3% |
| Nonylphenol + 9 EO | 2% |
| Tetrapotassium diphosphate | 5% |
| Na Metasilicate.$5H_2O$ | 2% |
| N—(β-Hydroxyethylpolyethoxy)aniline (n = 2.5) | 5% |
| Remainder up to 100%: $H_2O$ | |

The floor cleaners wherein the agent according to this invention can be employed comprise in general an anionic and/or nonionic tenside and optionally an inorganic basic compound. The composition of such floor cleaners and their use are, unless indicated otherwise herein, fully conventional except for the new polymer dissolving agents of this invention. See, e.g. E. W. Flick, Household and Automotive Chemical Specialties, Recent Formulations, Noyes Data Corporation, p. 102, 277–280 (1979), Jahrbuch für den Praktiker, Verlag für chemische Industrie H. Ziolkowsky KG, Augsburg: annual editions, whose disclosures are incorporated by reference herein, for a discussion of typical components and overall compositions. The components of this invention are contained therein usually in amounts of 0.5–15 wt %, preferably 2–8 wt %. Other components usually present include:

- 2–20% anionic surfactants (typical agents: salts of fatty acids (soaps) alkylbenzenesulfonates, long chain alklylsulfates, long chain alkylethersulfates, paraffinsulfonates)
- 0–15% nonionic surfactants (typical agents: fatty alcohol ethoxylates, alkylphenol ethoxylates, fatty amine ethoxylates, ethylenoxide/propylenoxide-addition products)
- 2–20% builders (typical agents: condensed phosphates, sodium silicate, sodium carbonates, nitrilotriacetate, ethylene diamine tetra acetate)
- 2–40% solvents (typical agents: alcohols (ethanol, n- and isopropanol, n- and isobutanol) and ethoxylates alcohols (especially: butylalycol, methylidiglycol), Ketones, esters Polymers which the components of this invention dissolve are the usual ones, e.g., those used in floor waxes, including polyethylene waxes, acrylic polymers and copolymers, styrene polymers and copolymers, paraffin waxes, resins and natural waxes.

The preceding examples can be repeated with similar success by substituting the generically or specifically described reactants and/or operating conditions of this invention for those used in the preceding examples. From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a surface cleaner, useful for cleaning floors, comprising a component for dissolving polymers, the improvement wherein the surface cleaner has essentially no blue coloration and said component is an N-oxalkylated aniline of the formula

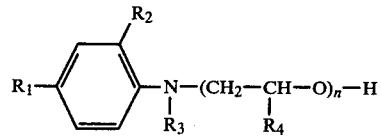

wherein $R_1$ and $R_2$ are the same or different and each is hydrogen, $NH_2$ or $C_{1-4}$-alkyl, $R_3$ is hydrogen or $C_{1-4}$-alkyl, $R_4$ is hydrogen or methyl, and n is a number from 1.0 to 5.0.

2. A cleaner of claim 1 wherein the n-oxalkylated aniline is of the formula

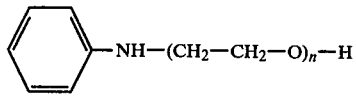

wherein n is as defined in claim 1.

3. A cleaner of claim 1 or 2 wherein n is a number from 1 to 3.

4. A cleaner of claim 3 wherein n is a number from 1 to 2.

5. A cleaner of claim 1 wherein $R_4$ is methyl.

6. A method of cleaning a floor-like surface comprising cleaning the surface with a cleaner comprising a component for dissolving polymers, wherein the cleaner is that of claim 1.

7. A method of cleaning a floor-like surface comprising cleaning the surface with a cleaner comprising a component for dissolving polymers, wherein the cleaner is that of claim 2.

8. A method of cleaning a floor-like surface comprising cleaning the surface with a cleaner comprising a component for dissolving polymers, wherein the cleaner is that of claim 3.

9. A method of cleaning a floor-like surface comprising cleaning the surface with a cleaner comprising a component for dissolving polymers, wherein the cleaner is that of claim 4.

10. A cleaner of claim 1 wherein n is a number from 1 to 1.5.

11. A cleaner of claim 2 wherein n is a number from 1 to 1.5.

12. In a surface cleaner, useful for cleaning floors, comprising a component for dissolving polymers, the improvement wherein the surface cleaner has essentially no blue coloration and said component is the product of the reaction of an amine of the formula

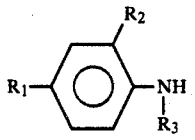

with an alkylene oxide of the formula

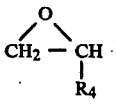

in the presence of an alkaline catalyst, wherein $R_1$ and $R_2$ are the same or different and each is hydrogen, $NH_2$ or $C_{1-4}$-alkyl;

$R_3$ is hydrogen or $C_{1-4}$-alkyl, $R_4$ is hydrogen or methyl using a molar ratio of reactants to produce a product of the formula

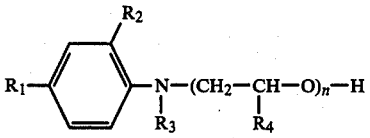

wherein n is a number from 1.0 to 5.0.

13. A method of dissolving polyethylene waxes, acrylic polymers or copolymers thereof, styrene polymers or copolymers thereof, paraffin waxes, resins or natural waxes, comprising treating such polymers with an N-oxalkylated aniline of the formula

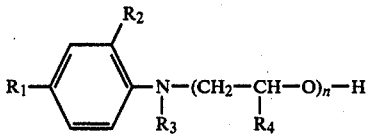

wherein $R_1$ and $R_2$ are the same or different and each is hydrogen, $NH_2$ or $C_{1-4}$-alkyl;

$R_3$ is hydrogen or $C_{1-4}$-alkyl, $R_4$ is hydrogen or methyl, and n is a number from 1.0 to 5.0.

* * * * *